US007563006B1

(12) United States Patent
Verfuerth et al.

(10) Patent No.: US 7,563,006 B1
(45) Date of Patent: Jul. 21, 2009

(54) FLUORESCENT LAMP CATCHER

(75) Inventors: Neal R. Verfuerth, Plymouth, WI (US); Kenneth J. Wetenkamp, Plymouth, WI (US)

(73) Assignee: Orion Energy Systems, Inc., Plymouth, WI (US)

( * ) Notice: Subject to any disclaimer, the term of this patent is extended or adjusted under 35 U.S.C. 154(b) by 178 days.

(21) Appl. No.: 11/555,680

(22) Filed: Nov. 1, 2006

Related U.S. Application Data

(63) Continuation-in-part of application No. 29/210,513, filed on Aug. 2, 2004, now abandoned.

(51) Int. Cl.
*F21V 15/00* (2006.01)
*F21Y 103/00* (2006.01)
*F21S 8/04* (2006.01)

(52) U.S. Cl. ..... 362/376; 362/225; 362/457

(58) Field of Classification Search ..... 362/217, 362/225, 376–378, 396, 391, 457; 248/50
See application file for complete search history.

(56) References Cited

U.S. PATENT DOCUMENTS

| | | | | |
|---|---|---|---|---|
| 790,337 | A | 5/1905 | Adams | |
| D123,825 | S | 12/1940 | Trilling | |
| D130,996 | S | 1/1942 | Chidsey, Jr. | |
| 2,304,445 | A | 12/1942 | Doane | |
| 2,403,240 | A * | 7/1946 | Sawin | 248/50 |
| 2,448,236 | A | 8/1948 | Schneiderman et al. | |
| 2,636,977 | A * | 4/1953 | Foster | 362/225 |
| 2,687,516 | A | 8/1954 | Schneiderman et al. | |
| 3,172,608 | A | 3/1965 | Ausman | |
| 3,194,958 | A | 7/1965 | Schneiderman et al. | |
| 3,210,538 | A * | 10/1965 | Picha et al. | 362/282 |
| 3,305,102 | A | 2/1967 | Saphirstein | |
| 3,337,035 | A * | 8/1967 | Pennybacker | 248/50 |
| 3,935,560 | A | 1/1976 | Dorn | |
| D246,827 | S | 1/1978 | Crawford | |
| 4,101,107 | A | 7/1978 | Antoszewski | |
| 4,229,780 | A | 10/1980 | Nelson | |
| 4,387,417 | A * | 6/1983 | Plemmons et al. | 362/376 |
| 4,514,793 | A | 4/1985 | Andreasen | |
| D283,786 | S | 5/1986 | Chap | |
| 4,779,293 | A | 10/1988 | Dabney et al. | |
| D300,804 | S | 4/1989 | Myers | |
| 5,001,614 | A | 3/1991 | Buss | |

(Continued)

FOREIGN PATENT DOCUMENTS

| | | |
|---|---|---|
| JP | 3-159612 | 7/1991 |

OTHER PUBLICATIONS

"Metal Scan Plates & Accessories," product listing, LDB Manufacturing Inc., 2002.

*Primary Examiner*—Alan Cariaso
(74) *Attorney, Agent, or Firm*—Foley & Lardner LLP

(57) ABSTRACT

A fluorescent lamp tube catcher formed of bent wire can be detachably engaged with a light fixture, with the central portion of the lamp tube catcher positioned below fluorescent tubes in the light fixture during use. In the event that a fluorescent lamp tube inadvertently becomes loose in the light fixture, the fluorescent lamp tube catcher can stop the loose fluorescent lamp tube from falling. The fluorescent lamp tube catcher can be loosely retained on the light fixture, for example while replacing a fluorescent lamp tube that has failed.

19 Claims, 14 Drawing Sheets

U.S. PATENT DOCUMENTS

| | | | | |
|---|---|---|---|---|
| D317,858 | S | 7/1991 | Hoskinson et al. | |
| 5,075,832 | A | 12/1991 | Pace | |
| 5,193,903 | A | 3/1993 | Anisfield | |
| 5,369,558 | A | 11/1994 | Munz | |
| 5,690,425 | A | 11/1997 | Knoll, Jr. | |
| D393,132 | S | 3/1998 | Baker | |
| 6,254,049 | B1 | 7/2001 | Goehly | |
| 6,530,681 | B2 * | 3/2003 | Sieczkowski | 362/404 |
| 6,644,836 | B1 * | 11/2003 | Adams | 362/396 |
| 2002/0008975 | A1 | 1/2002 | Uedono et al. | |
| 2002/0172049 | A1 * | 11/2002 | Yueh | 362/376 |
| 2003/0179577 | A1 * | 9/2003 | Marsh | 362/260 |

* cited by examiner

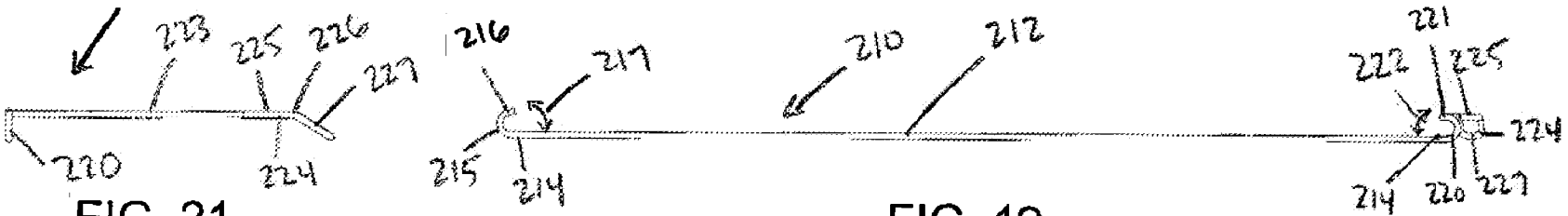
FIG. 19
FIG. 21
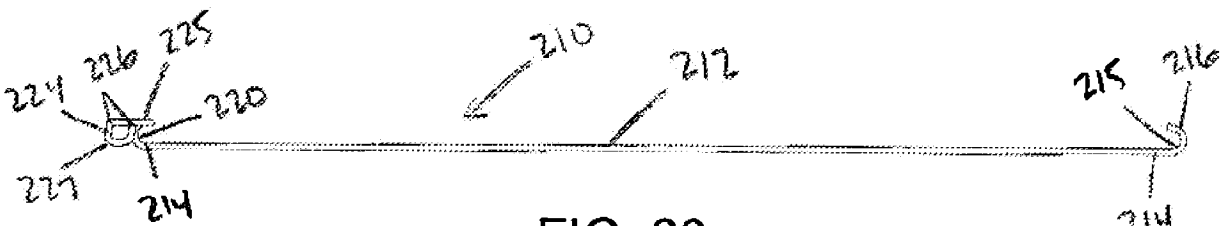
FIG. 20

FLUORESCENT LAMP CATCHER

CROSS-REFERENCE TO RELATED APPLICATIONS

This application claims priority to design patent application no. 29/210,513, filed Aug. 2, 2004, the disclosure of which is incorporated by reference.

FIELD OF THE INVENTION

This invention relates generally to the field of fluorescent lighting, and more specifically to safety devices for fluorescent lighting.

BACKGROUND OF THE INVENTION

Fluorescent light fixtures, for example of the sort described in U.S. Pat. No. 6,585,396, the disclosure of which is incorporated by reference, include one or more fluorescent lamps formed as elongated tubes. For a variety of reasons, these elongated fluorescent lamp tubes can become loose and drop out of the light fixture. This can present a hazard to persons and property below.

What is needed is an elegant and cost-effective device to catch a fluorescent lamp which becomes loose before it falls out of a light fixture. What is further needed is such a device to catch a fluorescent lamp, where the device can be applied to or removed from the light fixture without the use of tools. What is further needed is such a device to catch a fluorescent lamp, where the device can be unmounted from the light fixture while still loosely retained by the light fixture, for example to prevent the device from falling when replacing the fluorescent lamp tube.

SUMMARY OF THE INVENTION

A first embodiment of a fluorescent lamp tube catcher according to the invention includes an elongated central portion between two lateral portions that include loops that are adapted to be secured to bolts on a light fixture.

A second embodiment of a fluorescent lamp tube catcher according to the invention includes an elongated central portion between two lateral portions that include hooks that are adapted to be clipped to reflector rims on a light fixture.

A third embodiment of a fluorescent lamp tube catcher according to the invention includes an elongated central portion between two lateral portions that include hooks that are adapted to be clipped to reflector rims on a light fixture, where one of the lateral portions also includes a retainer portion that is adapted to be loosely retained on a bolt on a light fixture.

Other aspects of the invention relate to kits that include at least a fluorescent light fixture and a fluorescent lamp catcher, and also to methods that use a fluorescent lamp catcher, such as a method of changing a fluorescent lamp. Further objects, features, and advantages of the invention will be apparent from the following detailed description when taken in conjunction with the accompanying drawings.

BRIEF DESCRIPTION OF THE DRAWINGS

In the drawings:

FIG. 19 is a front view of the fluorescent lamp catcher of FIG. 17;

FIG. 20 is a rear view of the fluorescent lamp catcher of FIG. 17;

FIG. 21 is a side view of the fluorescent lamp catcher of FIG. 17;

DETAILED DESCRIPTION OF THE INVENTION

Figure 1:
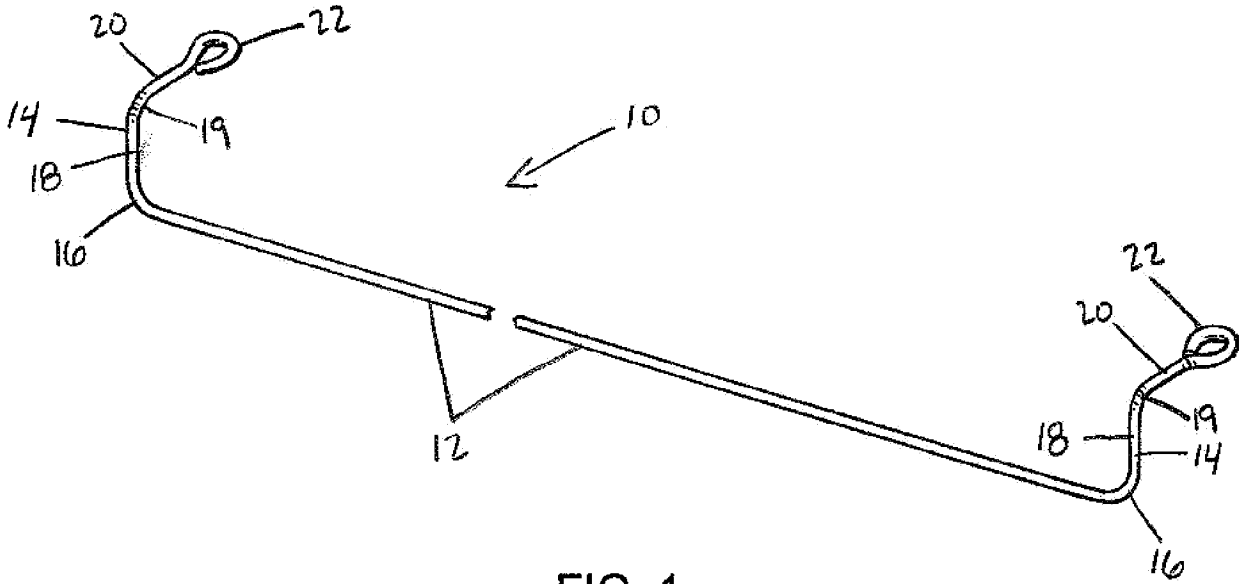
FIG. 1 is a perspective front view of a first embodiment of a fluorescent lamp catcher according to the invention.
Figure 2:
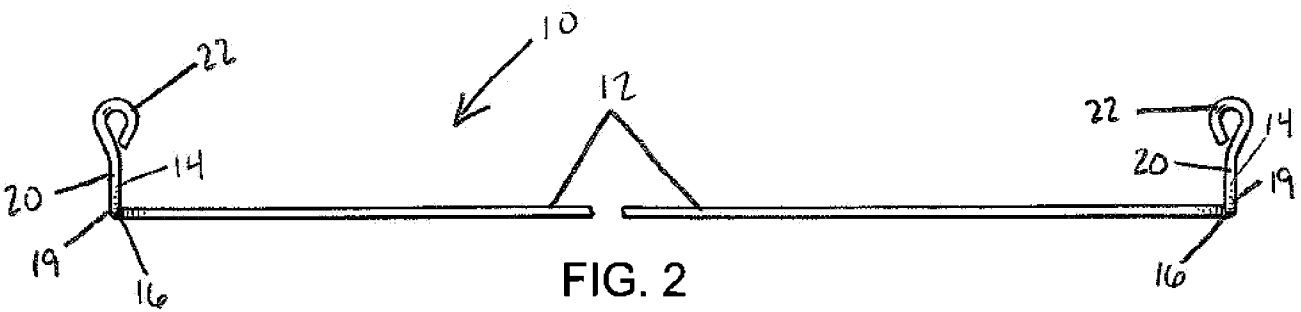
FIG. 2 is a top view of the fluorescent lamp catcher of FIG. 1.
Figure 3:
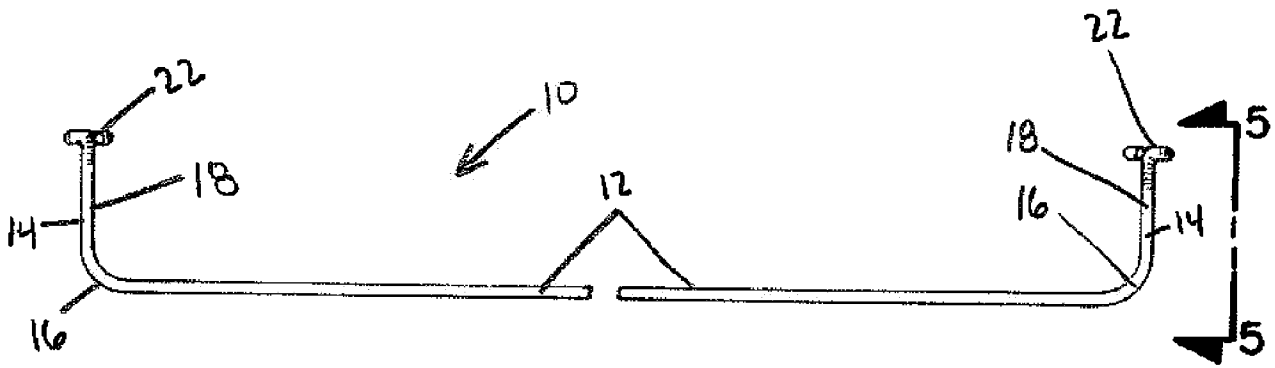
FIG. 3 is a front view of the fluorescent lamp catcher of FIG. 1.
Figure 4:
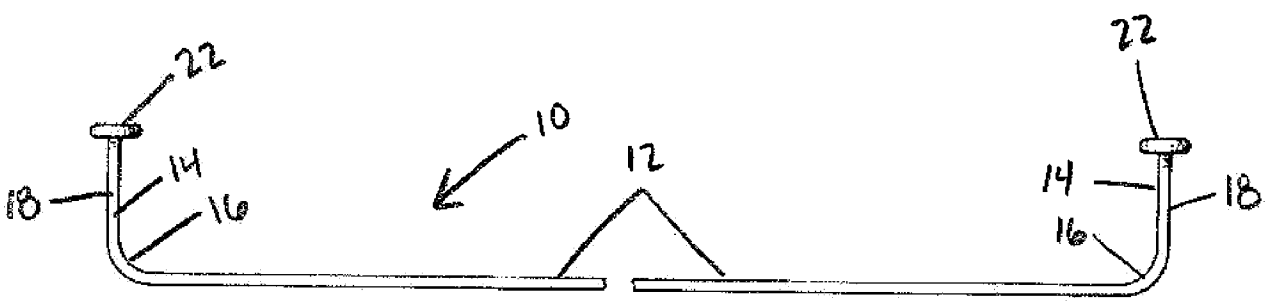
FIG. 4 is a rear view of the fluorescent lamp catcher of FIG. 1.
Figure 5:
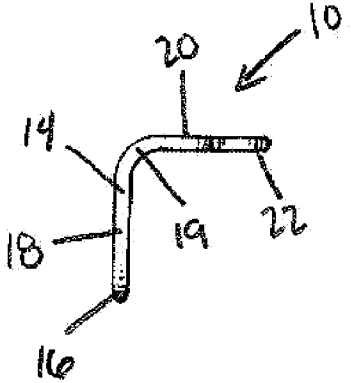
FIG. 5 is a side view of the fluorescent lamp catcher of FIG. 1.

FIGS. 1-5 provide various views of a first embodiment of a fluorescent lamp catcher (also known as a fluorescent tube catcher or light tube catcher) according to the invention, indicated generally at 10. The light tube catcher 10 includes a central portion 12 between two lateral portions 14. In the light tube catcher 10, each lateral portion 14 includes a first bend 16, a vertical portion 18, a second bend 19, a lengthwise portion 20, and a mounting portion 22 formed as a loop. This particular structure is not required, and different structures could be used with different light fixture structures. It is not necessary that the mounting portion 22 forms an entire loop, a portion of a loop could be used at one or both ends.

The light tube catcher 10 is preferably formed by bending a unitary piece of metal wire of appropriate length into the desired shape, as this can be a particularly cost-effective method. However, this is not required and other materials and methods of construction could be used. For example, a molded plastic or other synthetic part could be used, or a part formed of multiple pieces could be used.

Figure 6:
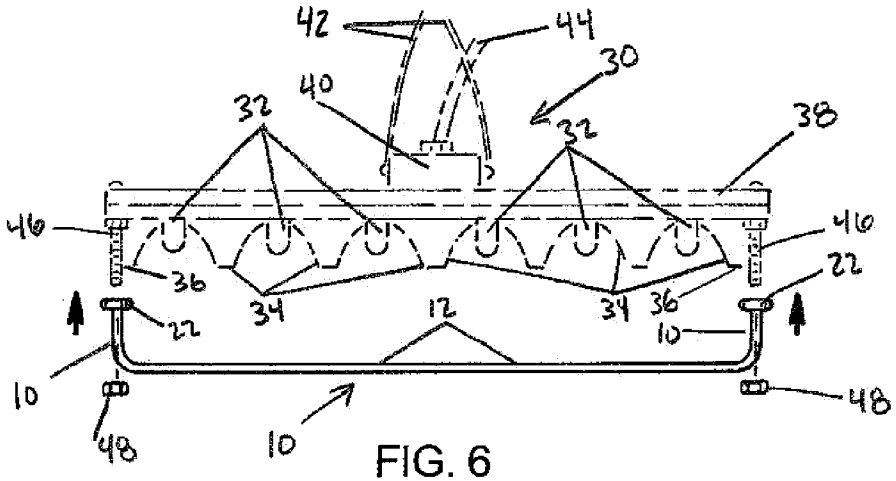
FIG. 6 is an end view of a fluorescent light fixture, with a rear view of the fluorescent lamp catcher of FIG. 1 positioned for mounting on the light fixture.
Figure 7:
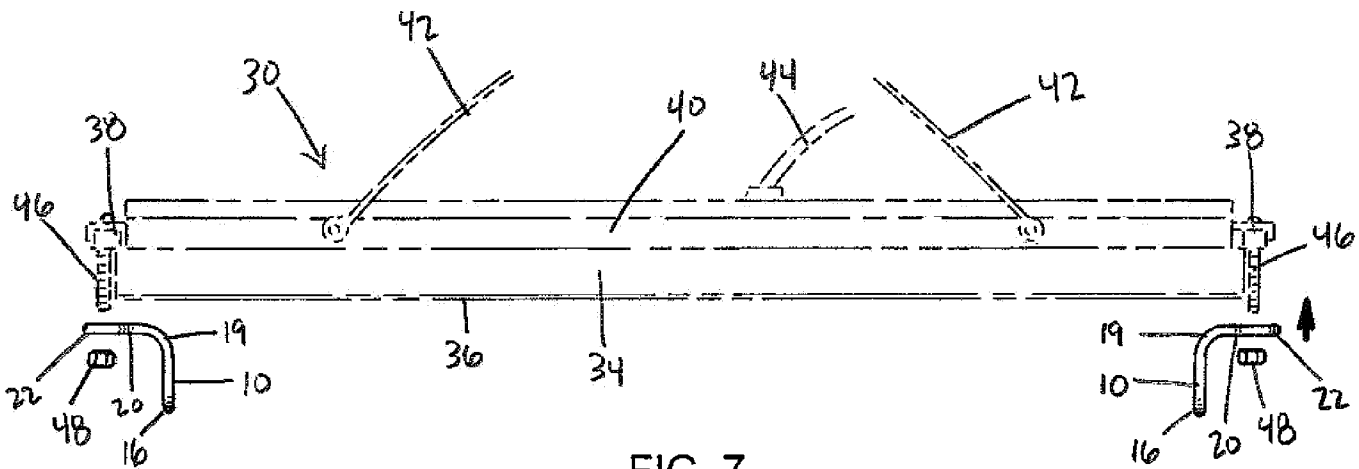
FIG. 7 is a side view of a fluorescent light fixture, with end views of two fluorescent lamp catchers of FIG. 1 positioned for mounting on the light fixture.

FIGS. 6-7 show the fluorescent lamp tube catcher 10 positioned for mounting on an exemplary light fixture 30. The light fixture 30 can have a so-called "I-beam" construction, which includes fluorescent lamp sockets 32, reflectors 34, and wiring (not shown) supported by a frame that can include two lateral frame members 38 at each end of a longitudinal frame member 40. The light fixture 30 can be suspended using suspension cables 42, and electrical power can be delivered to the fixture using a power supply cable 44. However, this particular structure is not required and other light fixture structures could be used.

As shown in FIGS. 6-7, the fluorescent lamp tube catcher 10 is positioned for mounting to the light fixture 30 by aligning the mounting portions 22 of the lamp tube catcher 10 with bolts 46 on the light fixture 30. After positioning the lamp tube catcher 10 on the bolts 46, a wrench can be used to tighten nuts 48 to secure the lamp tube catcher 10 on the bolts 46 and light fixture 30. The bolts 46 can be long enough that when the nuts 48 are loosened to near the end of the bolts 46, but not removed, this gives the tube catcher 10 enough freedom of movement to provide sufficient clearance to allow replacement of fluorescent lamps in the fixture without completely disengaging the tube catcher 10 from the fixture 30.

Figure 8:
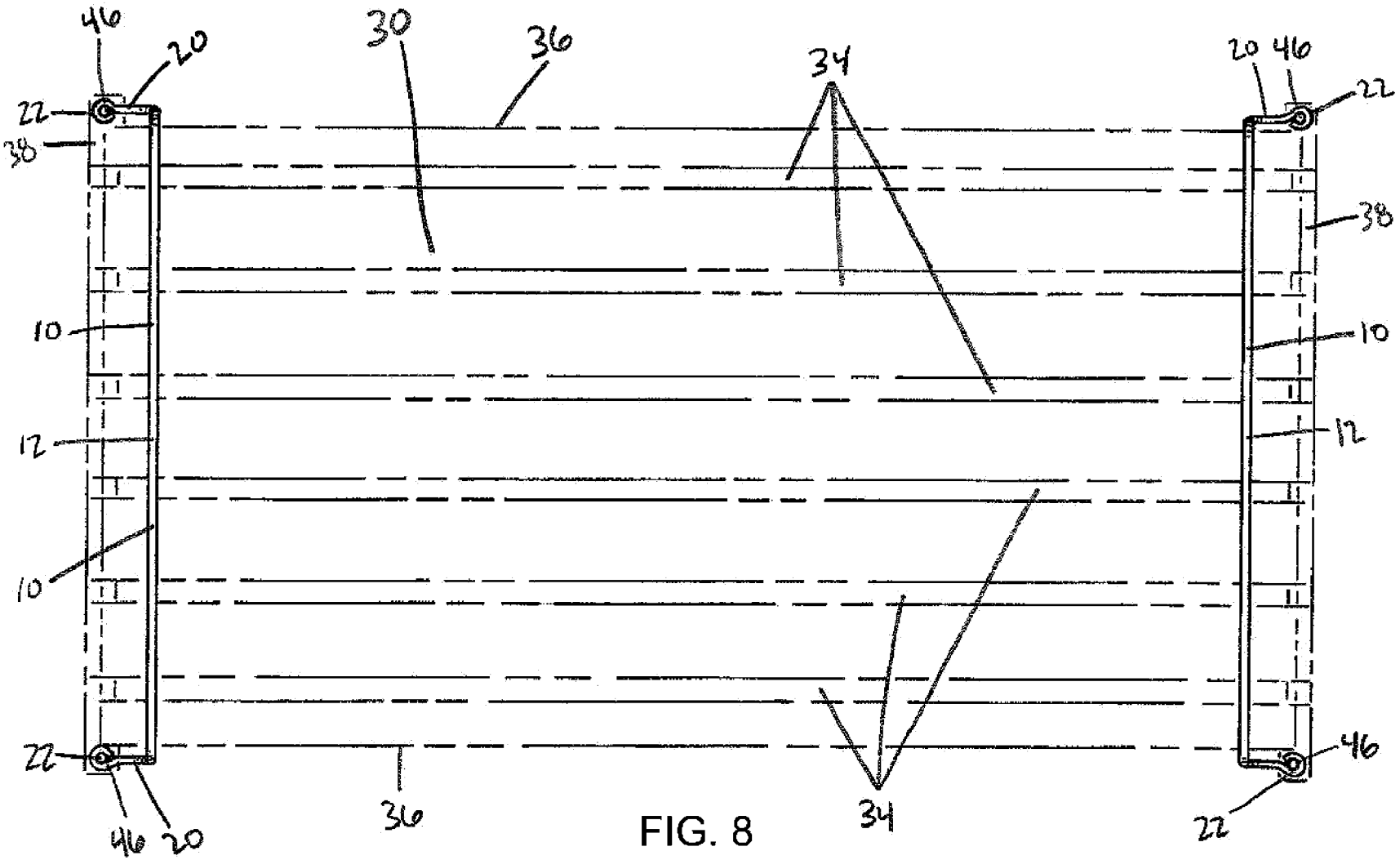
FIG. 8 is a bottom view of a fluorescent light fixture, with a bottom view of two fluorescent lamp catchers of FIG. 1 mounted on the light fixture.
Figure 9:
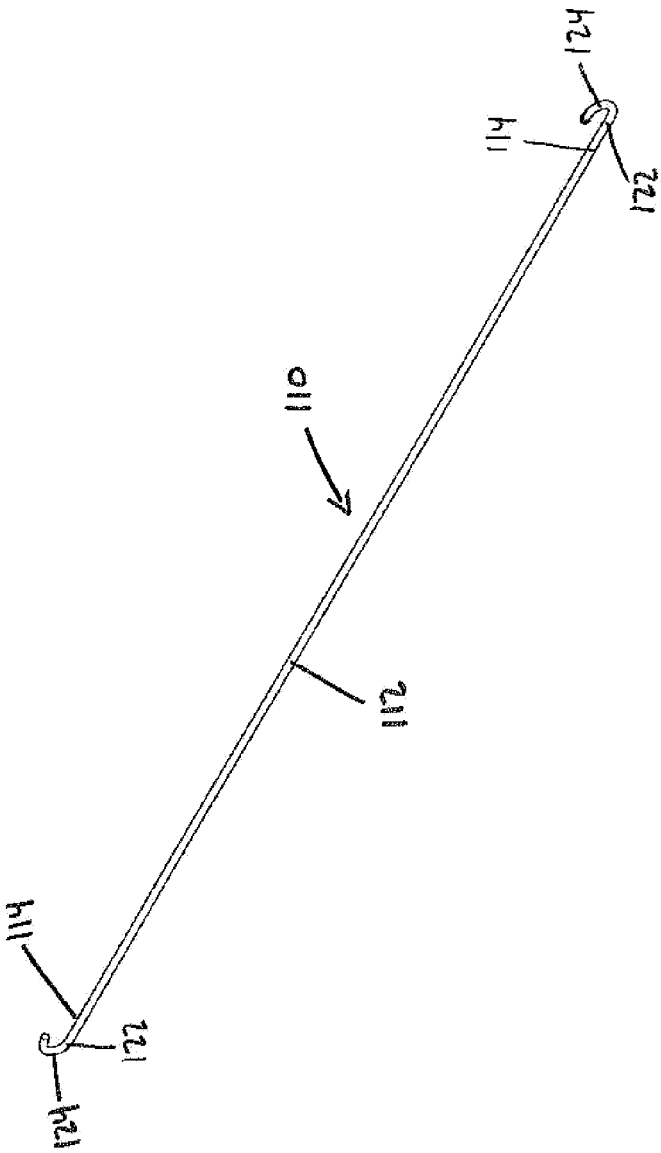
FIG. 9 is a perspective front view of a second embodiment of a fluorescent lamp catcher according to the invention.
Figure 10:
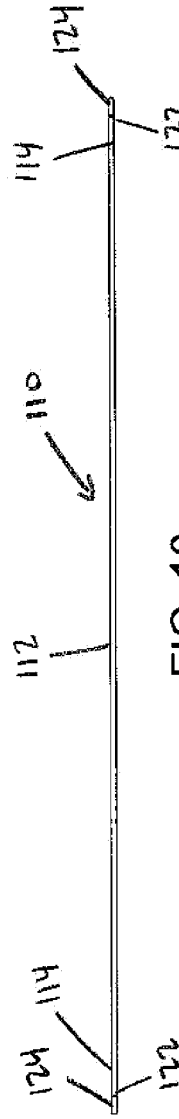
FIG. 10 is a top view of the fluorescent lamp catcher of FIG. 9.
Figure 11:
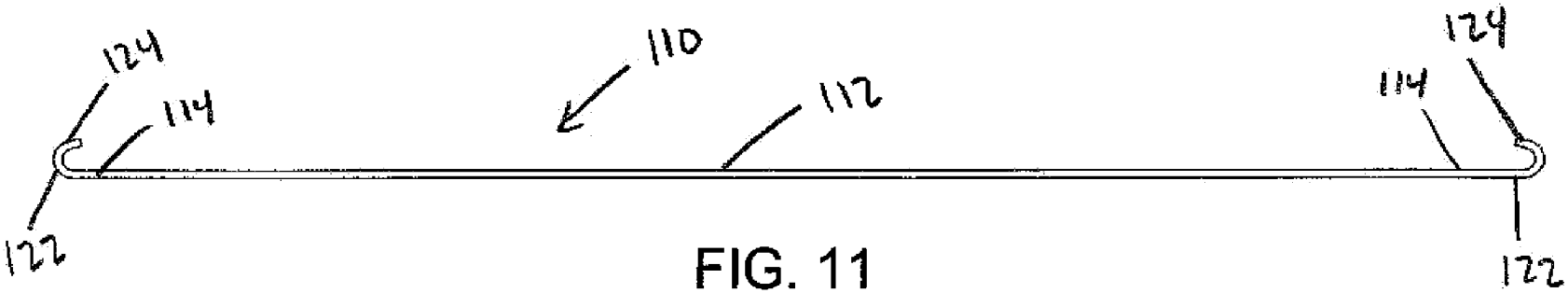
FIG. 11 is a front view of the fluorescent lamp catcher of FIG. 9.

FIG. 8 shows two fluorescent lamp tube catchers 10 positioned with their mounting portions 22 on the bolts 48 of a light fixture 30. The nuts 48 are not shown in FIG. 8 to avoid obscuring the mounting portions 22. As best shown in FIG. 8, the central portions 12 of the fluorescent lamp tube catchers 10 extend across the light fixture 30 between the reflector rims 36, whereby the lamp tube catchers are positioned to catch any lamp that may become loose.

Figure 12:
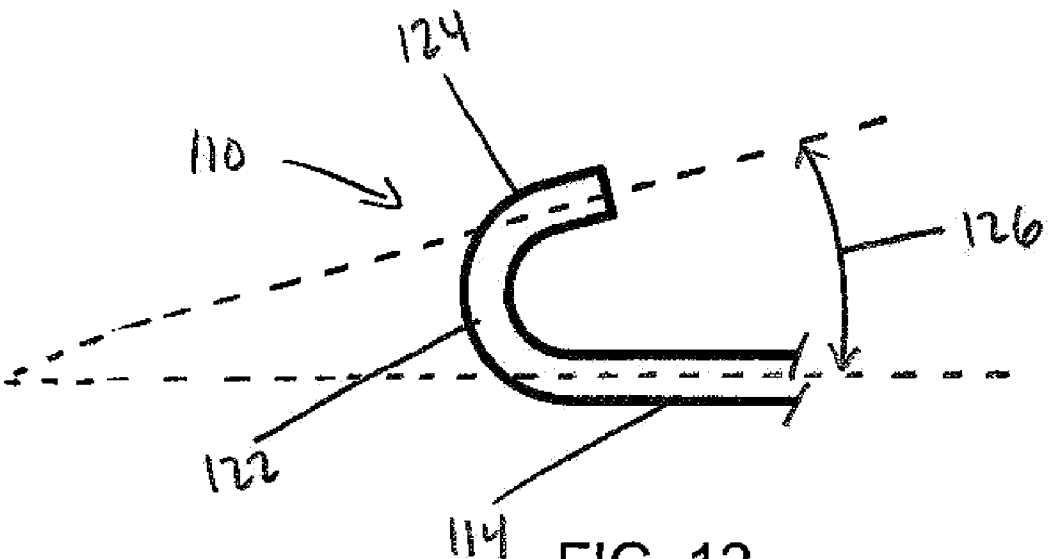
FIG. 12 is a side view of the fluorescent lamp catcher of FIG. 9.

FIGS. 9-12 provide various views of a second embodiment of a fluorescent lamp tube catcher according to the invention, indicated generally at 110. The light tube catcher 110 includes a substantially straight central portion 112 between two lateral portions 114. Each lateral portion 114 includes a mounting portion 122 that can be formed as a mounting hook 124. As best shown in FIG. 12, the mounting hook 124 can be formed with a mounting hook angle 126 of about 20 degrees. This particular structure is not required, and different structures could be used with different light fixture structures.

The light tube catcher 110 is preferably formed by bending a unitary piece of metal wire into the desired shape, as this can be a particularly cost-effective method. However, this is not required and other materials and methods of construction could be used. For example, a molded plastic or other synthetic part could be used, or a part formed of multiple pieces could be used.

Figure 13:
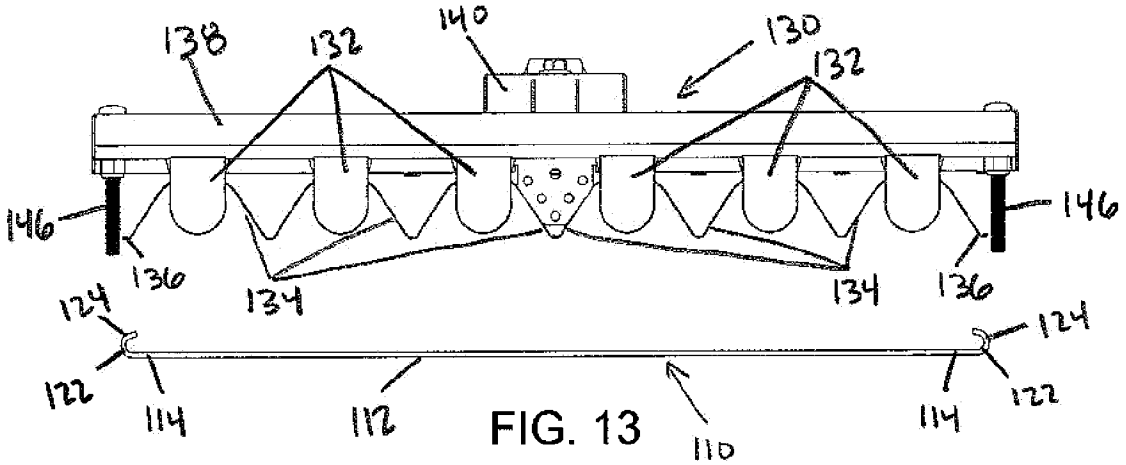
FIG. 13 is an end view of a fluorescent light fixture, with the fluorescent lamp catcher of FIG. 9 positioned for mounting on the light fixture.
Figure 14:
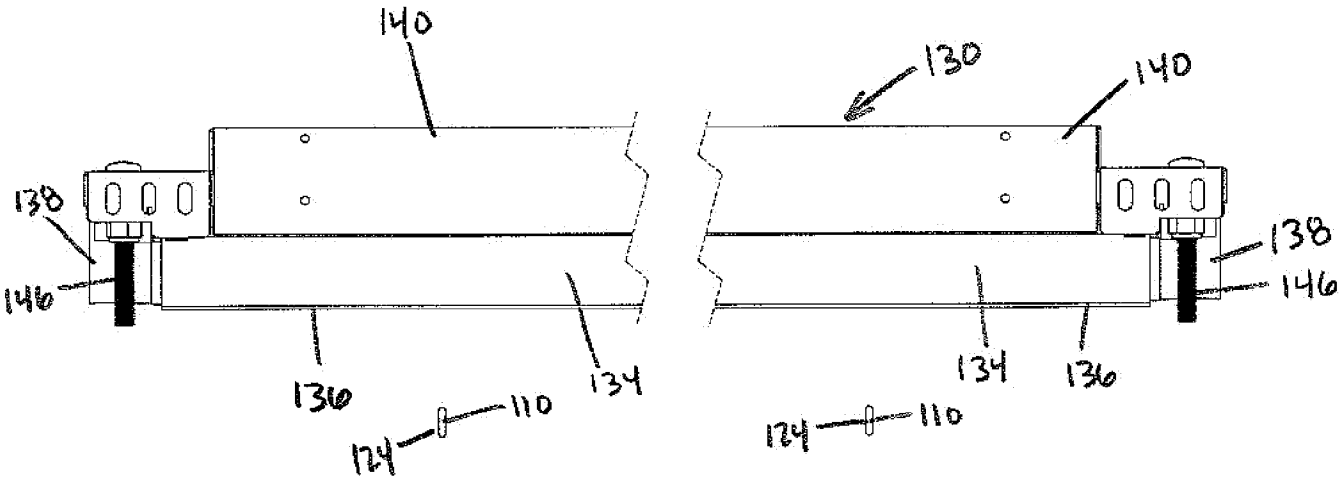
FIG. 14 is a side view of a fluorescent light fixture, with two fluorescent lamp catchers of FIG. 9 positioned for mounting on the light fixture.

FIGS. 13-14 show the fluorescent lamp tube catcher 110 positioned for mounting on an exemplary light fixture 130. The light fixture 130 can have a so-called "I-beam" construction, which includes fluorescent lamp sockets 132, reflectors 134, and wiring (not shown) supported by a frame that can include two lateral frame members 138 at each end of a longitudinal frame member 140. However, this particular structure is not required and other light fixture structures could be used.

Figure 15:
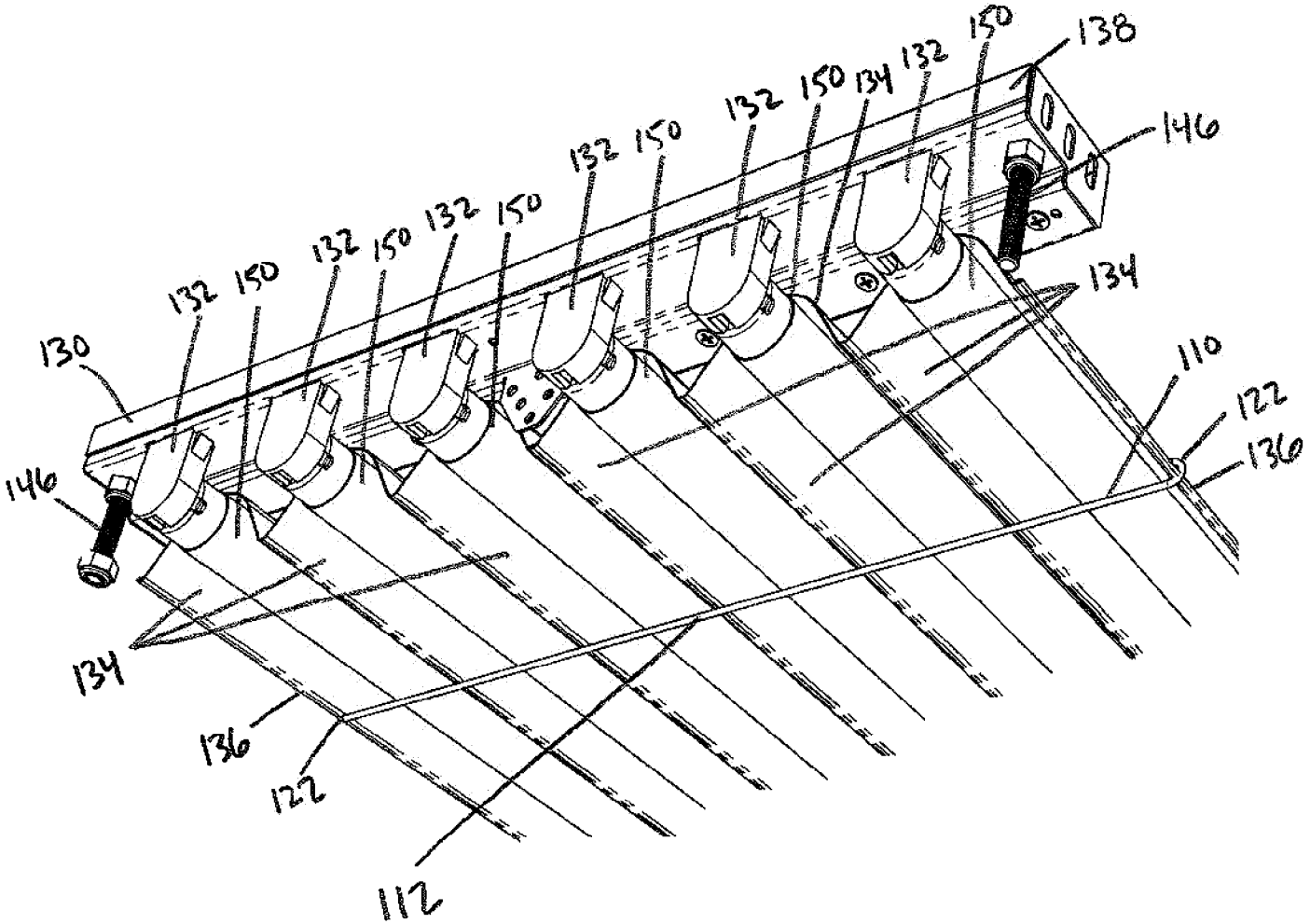
FIG. 15 is a bottom perspective view of one end of a fluorescent light fixture, with the fluorescent lamp catcher of FIG. 9 mounted on the light fixture.

As shown in FIGS. 13-14, the fluorescent lamp tube catcher 110 is positioned for mounting to the light fixture 130 by aligning the mounting portions 122 and mounting hooks 124 of the lamp tube catcher 110 above the lateral reflector rims 136 on the light fixture 130. After positioning the lamp tube catcher 110 above the lateral reflector rims 136, the mounting hooks 124 are clipped on a lateral structure on the light fixture, such as the reflector rims 136, to secure the lamp tube catcher 110 on the light fixture 130 as shown in FIG. 15. Importantly, this embodiment of a lamp tube catcher 110 can be clipped on and off the light fixture 130 without the use of tools, for example when it is necessary to replace a failed fluorescent lamp.

FIG. 15 shows one end of a fluorescent light fixture 130, with a fluorescent lamp tube catcher 110 secured to the light fixture 130 with the mounting hooks 124 of the lamp tube catcher 110 clipped on the lateral reflector rims 136 of the light fixture 130. As best shown in FIG. 15, the central portion 112 of the fluorescent lamp tube catcher 110 extends across the light fixture 130 between the reflector rims 136, whereby the lamp tube catcher 110 is positioned to catch any fluorescent lamp tube 150 which may become loose.

Figure 16A:
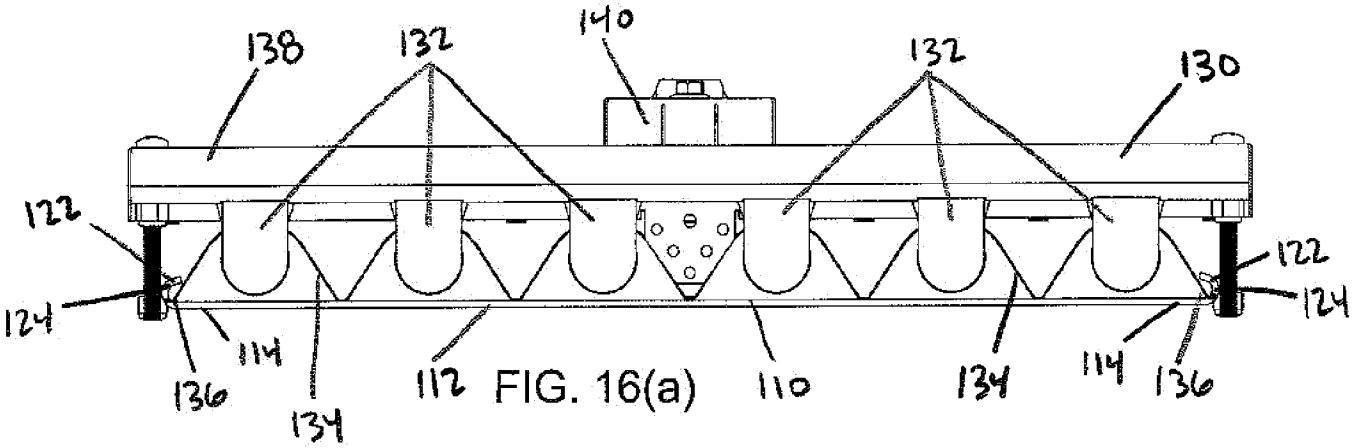
FIG. 16(*a*) is an end view of a fluorescent light fixture with the fluorescent lamp catcher of FIG. 9 mounted on the light fixture, and FIG. 16(*b*) is the same view but with one fluorescent lamp loosened from the light fixture and caught by the lamp catcher.
Figure 16B:
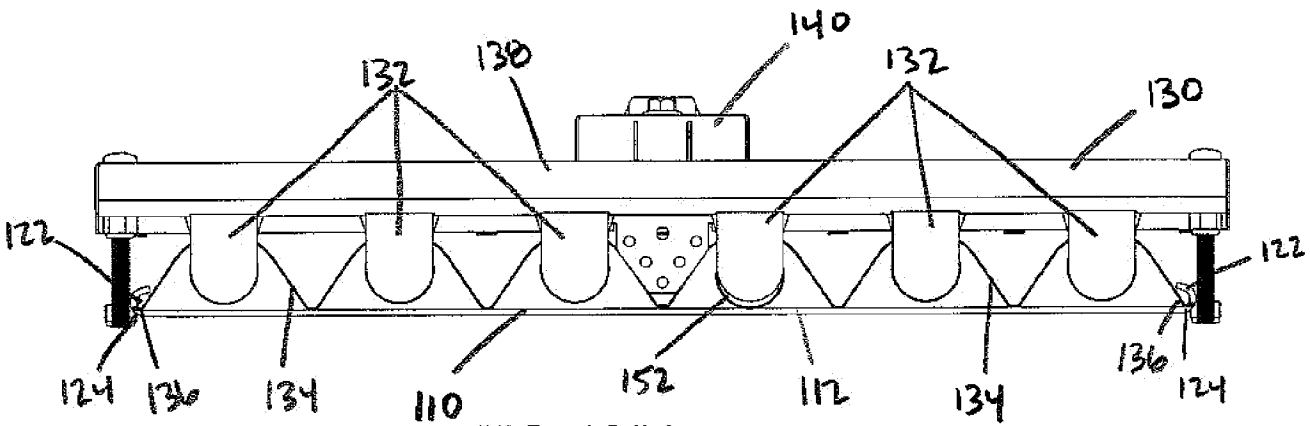
Figure 17:
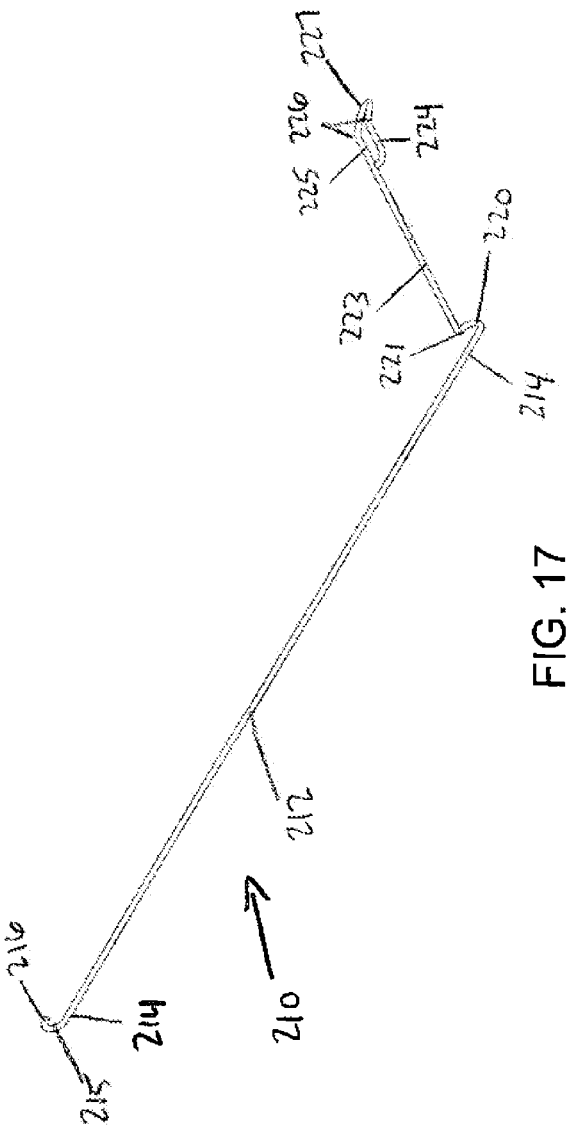
FIG. 17 is a perspective front view of a third embodiment of a fluorescent lamp catcher according to the invention.
Figure 18:
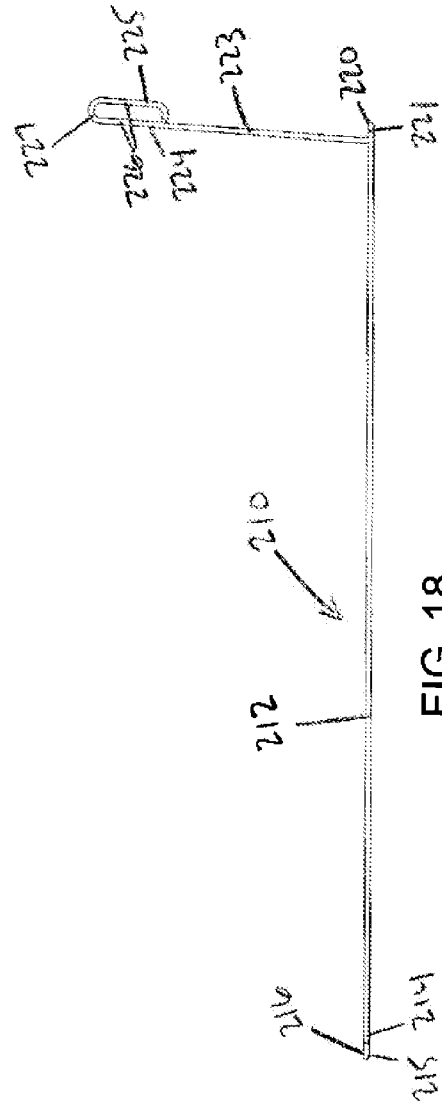
FIG. 18 is a top view of the fluorescent lamp catcher of FIG. 17.

FIGS. 16(*a*) and 16(*b*) show how a fluorescent lamp tube catcher according to the invention, such as the fluorescent lamp tube catcher 110, can prevent a loosened fluorescent tube from falling. FIG. 16(*a*) is an end view of a fluorescent light fixture 130 with the fluorescent lamp tube catcher 110 mounted on the light fixture, and FIG. 16(*b*) is the same view but with one fluorescent lamp 152 loosened from the light fixture 130 and caught by the lamp catcher 110.

FIGS. 17-21 provide various views of a third embodiment of a fluorescent lamp tube catcher according to the invention, indicated generally at 210. The light tube catcher 210 includes a central portion 212 between lateral portions 214. The first lateral portion 214 includes a first mounting portion 215 with a first mounting hook 216 that has a first mounting hook angle 217 that is preferably about 20 degrees. In that regard, the first lateral portion 214 is similar to the lateral portions 114 of the light tube catcher 110.

The second lateral portion 214 of the lamp tube catcher 210 also includes a second mounting portion 220 with a second mounting hook 221 that has a second mounting hook angle 222 that is preferably about 20 degrees. In the lamp tube catcher 210, the second lateral portion 214 is connected to a retainer offset portion 223 to a retainer portion 224. The retainer portion 224 can have a retainer proximal portion 225, a retainer portion bend 226, and a retainer distal portion 227. This particular structure is not required, and different structures could be used with different light fixture structures.

The light tube catcher 210 is preferably formed by bending a unitary piece of metal wire into the desired shape, as this can be a particularly cost-effective method. However, this is not required and other materials and methods of construction could be used. For example, a molded plastic or other synthetic part could be used, or a part formed of multiple pieces could be used.

Figure 22:
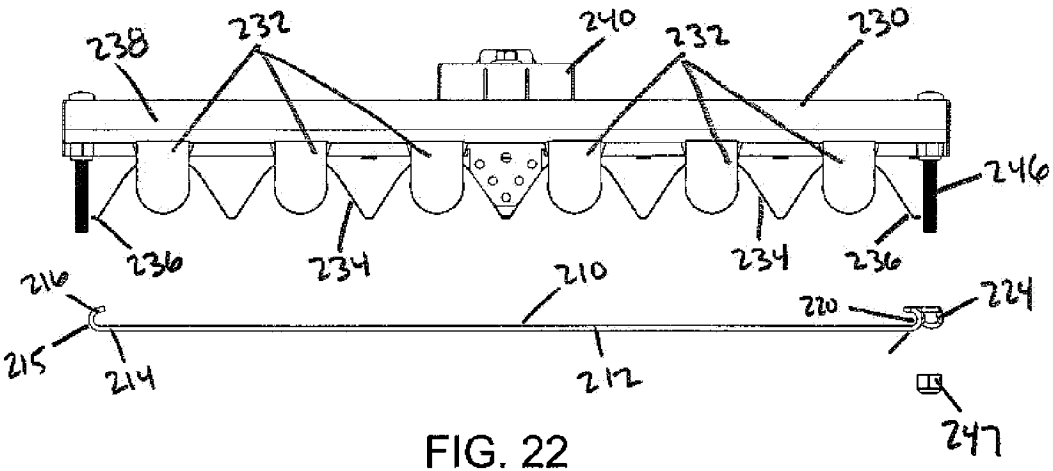
FIG. 22 is an end view of a fluorescent light fixture, with the fluorescent lamp catcher of FIG. 17 positioned for mounting on the light fixture.
Figure 23:
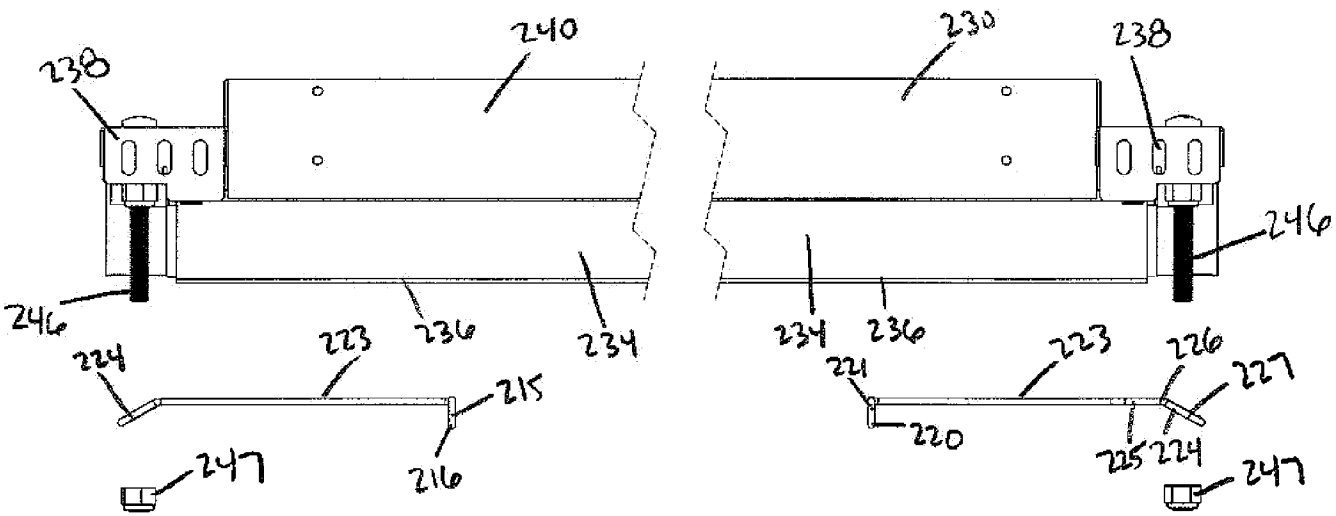
FIG. 23 is a side view of a fluorescent light fixture, with two fluorescent lamp catchers of FIG. 17 positioned for mounting on the light fixture.

FIGS. 22-23 show the fluorescent lamp tube catcher 210 positioned for mounting on a light fixture 230. The light fixture 230 can have a so-called "I-beam" construction, which includes a plurality of fluorescent lamp sockets 232, one or more reflectors 234, and wiring (not shown) supported by a frame that includes two lateral frame members 238 at each end of a longitudinal frame member 240. However, this particular structure is not required and other light fixture structures could be used.

As shown in FIGS. 22-23, the fluorescent lamp tube catcher 210 is positioned for mounting to the light fixture 230 by aligning the retainer portion 224 above a bolt 246 on the light fixture 230. Once aligned, the retainer portion 224 can be moved onto the bolt 246, with the bolt 246 through the retainer portion 224. Once the retainer portion 224 is on the bolt 246, a nut 247 can be loosely tightened on the bolt 246 to loosely retain the lamp tube catcher 210 on the bolt 246.

Once the lamp tube catcher 210 is loosely retained on the light fixture 230 in this fashion, the lamp tube catcher 210 can be positioned above the lateral reflector rims 236. Next, the first mounting portion 215 and first mounting hook 216 can be clipped on the far reflector rim 236 to secure that free end of the lamp tube catcher 210 to the light fixture 230. Finally, the second mounting portion 220 and second mounting hook 216 can be clipped on the near reflector rim 236 to finish securing the lamp tube catcher 210 to the light fixture 230.

Importantly, this embodiment of a lamp tube catcher 210 can be clipped on and off the light fixture 230 without the use of tools, for example when it is necessary to replace a failed fluorescent lamp, while loosely retaining the lamp tube catcher 210 on the light fixture 230. Because the lamp tube catcher 210 is loosely retained at only one end, the bolt 246 forms a pivot point so the tube catcher 210 can be rotated well away from the light fixture 230 to provide excellent clearance while replacing a fluorescent lamp. Because the tube catcher 210 is loosely retained on the light fixture 230, there is no risk that the tube catcher 210 will fall to the ground, or any need to find a place to put the tube catcher 210, while at the top of a ladder replacing a fluorescent lamp. Because the retainer portion 224 can freely travel along the shaft of the bolt 246 while loosely retained by the nut 247, the lamp tube catcher 210 has excellent freedom of movement about the pivot point of the bolt 246.

Figure 24:
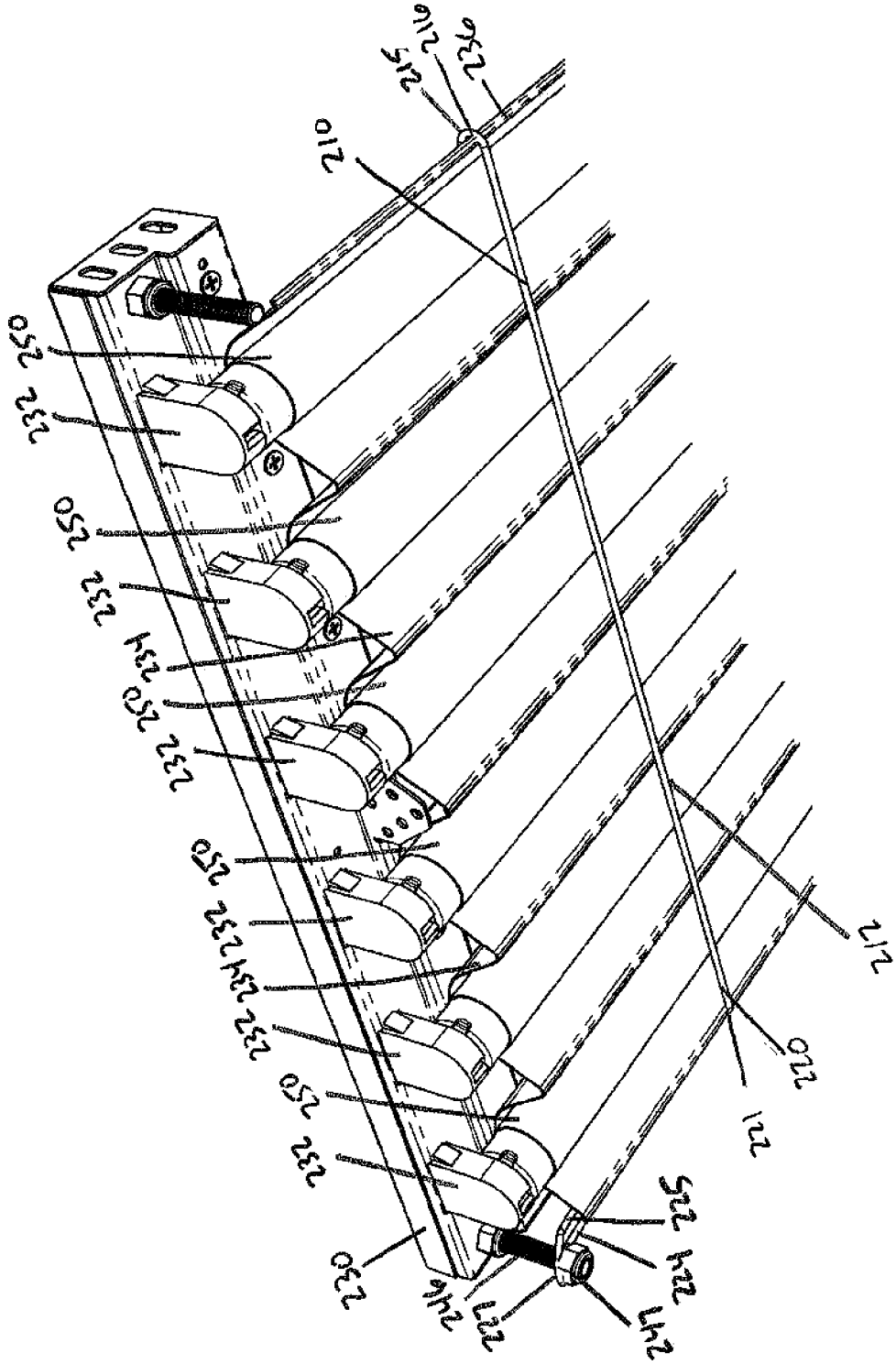
FIG. 24 is a bottom perspective view of one end of a fluorescent light fixture, with the fluorescent lamp catcher of FIG. 17 mounted on the light fixture.

FIG. 24 shows one end of a fluorescent light fixture 230, with a fluorescent lamp tube catcher 210 clipped on the lateral reflector rims 236 of the light fixture 230 and with the lamp tube catcher 210 loosely retained on the light fixture 230. As best shown in FIG. 24, the central portion 212 of the fluorescent lamp tube catcher 210 extends across the light fixture 230 between the reflector rims 236, whereby the lamp tube catcher 210 is positioned to catch any fluorescent lamp tube 250 which may become loose.

Figure 25A:
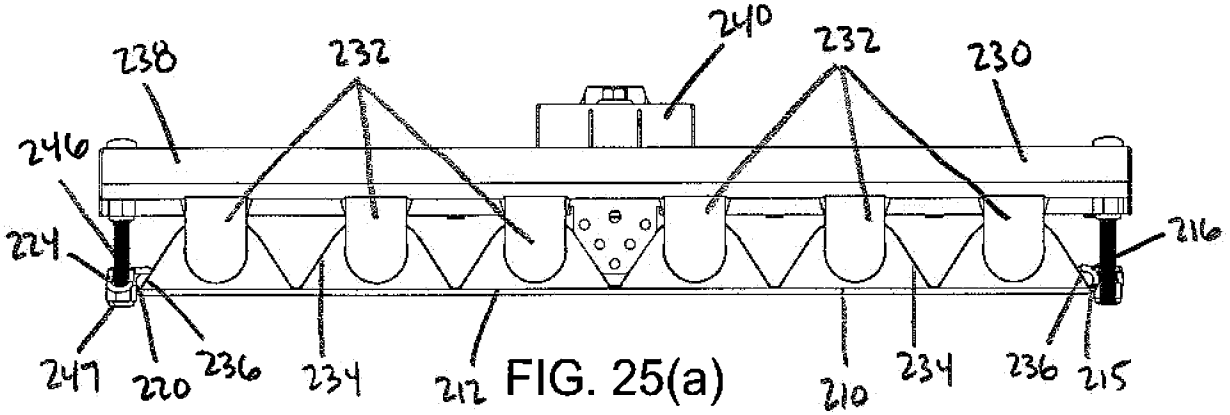
FIG. 25(*a*) is an end view of a fluorescent light fixture with the fluorescent lamp catcher of FIG. 17 mounted on the light fixture, and FIG. 25(*b*) is the same view but with one fluorescent lamp loosened from the light fixture and caught by the lamp catcher.
Figure 25B:
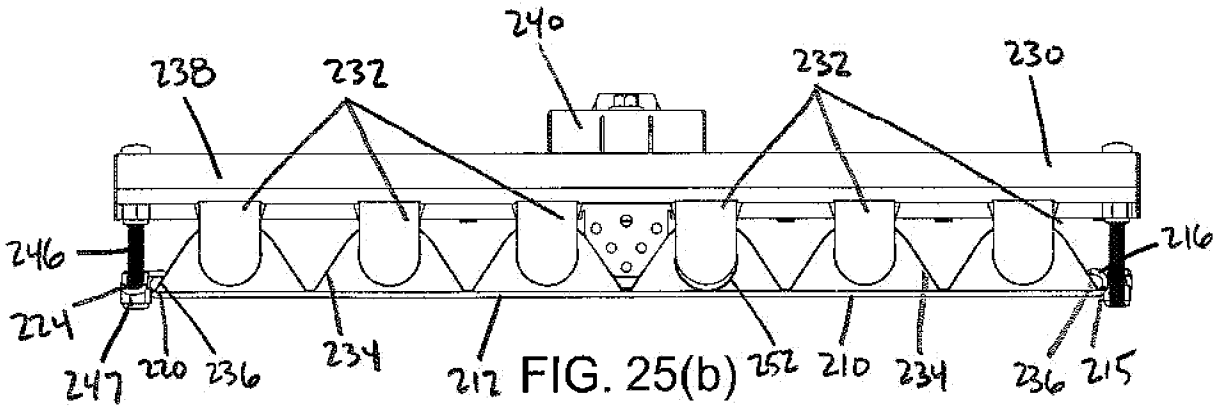

FIGS. 25(*a*) and 25(*b*) show how a fluorescent lamp tube catcher according to the invention, such as the fluorescent lamp tube catcher 210, can prevent a loosened fluorescent tube from falling. FIG. 25(*a*) is an end view of a fluorescent light fixture with the fluorescent lamp tube catcher 210 mounted on the light fixture, and FIG. 25(*b*) is the same view but with one fluorescent lamp 252 loosened from the light fixture 230 and caught by the lamp catcher 210.

There are various possibilities with regard to alternative embodiments and methods including a fluorescent lamp tube catcher according to the invention.

Although the preferred embodiments according to the invention disclosed herein are formed by bending a unitary piece of wire into the desired shape, other constructions could be used. For example, a flat strap of material could be bent into the desired shape and used instead of a wire. Also, it is not required that the device be formed by bending—any suitable process known in the art such as molding, thermoforming, stamping, or extruding could be used.

Similarly, although the preferred embodiments disclosed herein include mounting portions that are formed as bent loops that engage bolts on a light fixture or hooks of wire that engage lateral reflector rims, other mounting portion structures could be used. The phrase "at least a portion of a loop" means either an entire loop, a portion of a loop, or a hook. For example, a slot could be formed in a flat strap of material, with the slot positioned to be clipped on a lateral reflector rim or other structure. Alternatively, the mounting portion could be a straight wire or strap end that could be inserted into a hole or slot in a portion of the light fixture.

It is not necessary that there be exactly two mounting portions or that the mounting portion or portions be secured to the light fixture at or near the lateral edges of the light fixture. If a retainer portion is provided on the lamp tube catcher, a retainer offset portion is not required. If a retainer offset portion is provided, it can be a unitary part of the lamp tube catcher, or it can be a cord, chain, or cable that connects the retainer portion to the remainder of the lamp tube catcher.

It is understood that the invention is not confined to the embodiments set forth herein as illustrative, but embraces all such forms thereof that come within the scope of the following claims.

What is claimed is:

1. A fluorescent lamp tube catcher for use with a light fixture having a frame supporting a reflector and one or more lamp tubes, the lamp catcher comprising:

a unitary member having a first leg and a second leg arranged substantially in an L shape, the first leg terminating at a first end having a first hook portion configured to directly and releasably engage an edge of the reflector, and the second leg terminating at a second end having a loop portion configured to be pivotally coupled to the frame.

2. The fluorescent lamp tube catcher of claim 1 wherein the loop portion is configured to be pivotally retained on a bolt extending from the frame.

3. The fluorescent lamp tube catcher of claim 2 wherein the first leg is configured to extend substantially across and perpendicular to an axis of the lamp tubes.

4. The fluorescent lamp tube catcher of claim 3 wherein the second leg is configured to extend substantially parallel to the axis of the lamp tubes.

5. The fluorescent lamp tube catcher of claim 1 wherein the unitary member is formed by bending a unitary piece of wire.

6. The fluorescent lamp tube catcher of claim 4 wherein the first leg comprises a second hook portion disposed proximate the second leg and configured to releasable engage an opposite side of the reflector.

7. The fluorescent lamp tube catcher of claim 6 wherein at least one of the first and second hook portions comprises a hook angle of about 20 degrees.

8. The fluorescent lamp tube catcher of claim 4 wherein the first and second legs are pivotally movable about an axis of the bolt between a first position and a second position to permit replacement of one or more of the lamp tubes without disconnecting the second leg from the frame and without the use of tools.

9. A kit comprising:

a light fixture having a frame supporting a reflector and at least one pair of lamp sockets positioned to receive a lamp tube adjacent to the reflector between a first mounting point and a second mounting point; and a lamp tube catcher comprising a unitary member having a first leg and a second leg arranged substantially in an L shape, the first leg terminating at a first end having a hook portion configured to directly and releasably engage an edge of the reflector, and the second leg terminating at a second end having a loop portion configured to be pivotally coupled to the frame;

whereby a lamp tube received in the lamp sockets that becomes loose will drop onto the first leg of the lamp tube catcher.

10. The kit of claim 9 wherein the unitary member of the lamp tube catcher is formed by bending a unitary piece of wire.

11. The kit of claim 10 wherein the lamp tube comprises a plurality of tubes and the reflector comprises a plurality of arched segments, where an outermost segment of the reflector further comprises an outwardly extending rim configured to releasably receive the hook portion.

12. The kit of claim 11 wherein the hook portion comprise a hook angle of about 20 degrees.

13. The kit of claim 11 further comprising another hook portion proximate the second leg and configured to engage another rim of the reflector.

14. The kit of claim 9 wherein the lamp tube catcher comprises a plurality of fluorescent lamp tube catchers independently movable and releasably relative to one another.

15. A method of replacing a fluorescent lamp, comprising:

(a) providing a light fixture having a frame supporting a reflector and at least one pair of fluorescent lamp sockets positioned to receive a fluorescent lamp tube adjacent to the reflector;

(b) inserting a fluorescent lamp tube into the fluorescent lamp sockets adjacent the reflector;

(c) providing a fluorescent lamp tube catcher comprising a first leg and a second leg arranged substantially in an L shape, the first leg terminating at a first end having a hook portion configured to directly and releasably engage an edge of the reflector, and the second leg terminating at a second end having a loop portion configured to be pivotally coupled to the frame;

(d) coupling the loop portion to the frame and detachably engaging the hook portion with a rim extending along an edge of the reflector, so that the first leg is positioned beneath the fluorescent lamp tube and substantially perpendicular to an axis of the fluorescent lamp tube.

16. The method of claim 15 wherein the fluorescent lamp tube comprises a plurality of tubes and the reflector comprises a plurality of arched segments, where an outermost segment on at least one side of the reflector further comprises an outwardly extending rim configured to releasably receive the hook portion.

17. The method of claim 15 wherein the fluorescent lamp tube catcher is formed by bending a unitary piece of wire.

18. The method of claim 15, wherein the fluorescent lamp tube catcher comprises a plurality of fluorescent lamp tube catchers independently movable and releasably relative to one another.

19. The method of claim 15 wherein the hook portion comprises a hook angle of about 20 degrees.

* * * * *